US005778460A

United States Patent [19]

Doell et al.

[11] Patent Number: 5,778,460

[45] Date of Patent: Jul. 14, 1998

[54] AUXILIARY TOILET SEAT

[75] Inventors: Michael Doell, Toronto; Stephen Edward Ryan, Mississauga, both of Canada

[73] Assignee: Variety Ability Systems Inc., Toronto, Canada

[21] Appl. No.: 670,208

[22] Filed: Jun. 20, 1996

[51] Int. Cl.[6] ..... A47K 13/00

[52] U.S. Cl. ..... 4/239; 4/237

[58] Field of Search ..... 4/239, 237, 238, 4/240, 241, 243.1; 297/188.08, 188.12, 250.1

[56] References Cited

U.S. PATENT DOCUMENTS

| | | | |
|---|---|---|---|
| 1,440,132 | 12/1922 | Chrisman | 4/239 |
| 1,950,016 | 3/1934 | Zuckerman | 4/239 |
| 2,053,566 | 9/1936 | Kreil | 4/239 |
| 2,127,020 | 8/1938 | Carlson | 4/239 |
| 2,494,813 | 1/1950 | Hughes | 4/239 |
| 2,518,272 | 8/1950 | Beckwith | 4/239 |
| 2,709,816 | 4/1955 | Lamb | 4/239 |
| 3,209,376 | 10/1965 | Drury Jr. | 4/254 |
| 3,905,051 | 9/1975 | Gozdziewski | 4/237 |
| 4,254,514 | 3/1981 | Sakamoto | 4/234 |
| 4,381,568 | 5/1983 | Brown | 4/239 |
| 4,477,932 | 10/1984 | Lenosky | 4/239 |
| 4,716,602 | 1/1988 | Brickhouse | 4/237 |
| 4,777,672 | 10/1988 | Gebhard et al. | 4/239 |
| 4,964,179 | 10/1990 | Kimes | 4/239 |
| 5,161,263 | 11/1992 | Geneve et al. | 4/483 |

OTHER PUBLICATIONS

Publication. Prior to Nov. 1, 1994. "Carrie Potty Seat (Tumble Forms)" By JA Preston, Clifton, NJ.

Publication. Prior to Nov. 1, 1994. "Columbia Toliet Supports" By Columbia Medical Manufacturing, Pacific Palisades, CA.

Publication Prior to Nov. 1, 1994. "Dukki" By Pin Dot Products, Niles, Illinois.

Publication Prior to Nov. 1, 1994. "Kaye Toliet Trainers" By Kaye Products Inc, Hillsborough, NC.

Publication Prior to Nov. 1, 1994. "Ortho–Kinetics Adaptive Commode/Shower Chair" By Ortho–Kinetics Inc., Waukesha, WI.

Publication Prior to Nov. 1, 1994. "Pediatric Toliet Seat" By Fred Sammons, Mississauga, Ont.

*Primary Examiner*—David J. Walczak

*Attorney, Agent, or Firm*—Rothwell, Figg, Ernet & Kurz p.c.

[57] ABSTRACT

An auxiliary seat for young children, particularly for use with children having physical disabilities, is removably connected to the bowl of a toilet. The seat base is a rear-facing horseshoe shape, with upstanding arms and back support. The auxiliary seat provides postural support, by way of contoured sitting surfaces, a deep contoured anterior support. The anterior trunk support is pivotally connected across the front of the seat, to support the trunk and forearms of the user. A separate, adjustable height footrest is provided, the seat having restraint straps that may be individually applied about the knees of the user. A flexible urine deflector is removably insertable at the front of the seat.

10 Claims, 4 Drawing Sheets

10
16
60
60
6
14
20
14
6
18
12
22
22
50
54
56
56
52

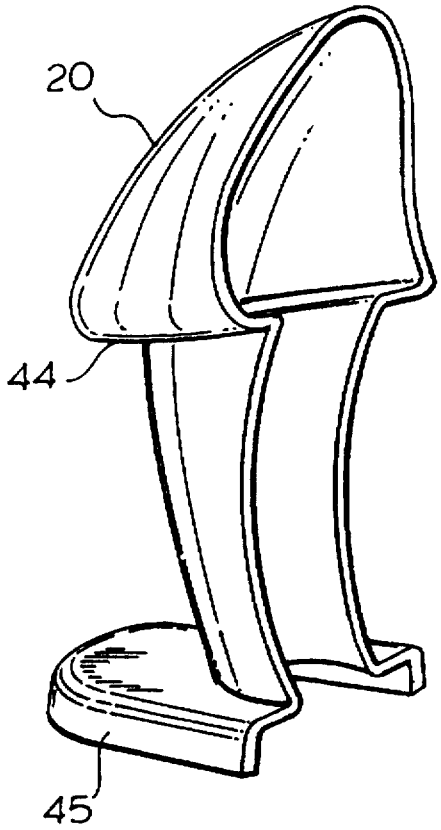
FIG. 2.
FIG. 4.
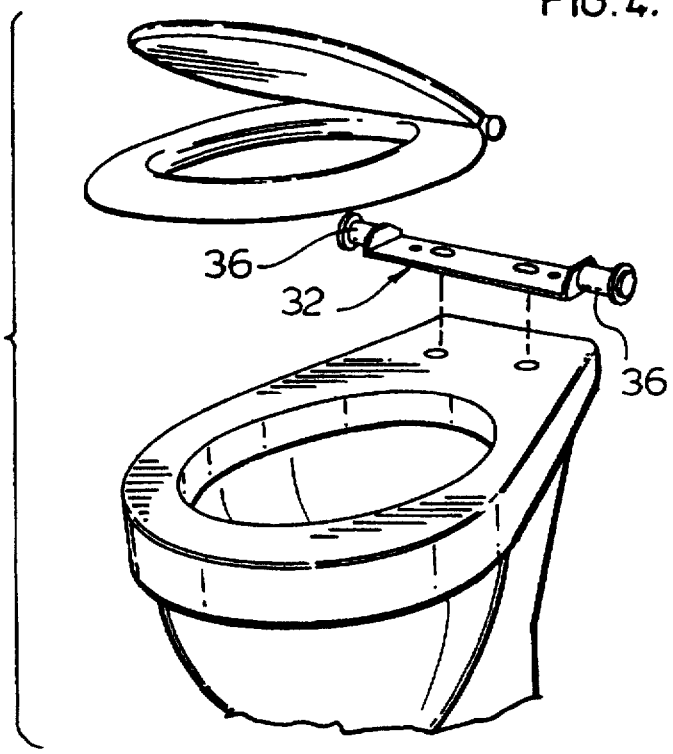

AUXILIARY TOILET SEAT

TECHNICAL FIELD

This invention is directed to an auxiliary seat, and in particular to an auxiliary toilet seat particularly for use with children having physical disabilities.

BACKGROUND ART

There is at present a pressing need for an auxiliary seat for use by children having physical disabilities.

Many such children have physical problems that have previously received insufficient consideration, so that the prior available auxiliary seats intended for use, for instance with a toilet, have not made adequate provision to accommodate such problems.

It is of course essential that the auxiliary seat be easy to mount and demount and that it have the capacity to be used for different applications such as bathing or even as a conventional seat.

One problem that is common to many of these children is an inability to support themselves in an upright sitting posture. The use of straps or other restrains has a counter-production effect in that the posture most contributive to effective bowel motion is thus precluded.

A further disadvantage of many prior art auxiliary seats is a tendency to neglect the importance of promoting a hip flexion angle of less than 90°. Failure to attend to said positioning could lead to abnormal posturing by encouraging pathological reflex patterns. This could have a dilatorious effect on the child's ability to be toileted.

A further desirable characteristic that is usually not found in seats from the prior art is the provision of overhang of the seat front edge. This overhang permits rearward flexing of the knees of the user. Allowance for knee flexion helps many children to maintain productive hip flexion which, in turn, helps to promote proper posture for toileting.

Still other auxiliary seats to not permit access to the disabled user's backside to facilitate cleaning.

PRIOR ART

There are not, to the knowledge of the inventors, any structures which provide the combination of an anterior support platform; a rearward opening; and a hook mounting.

In the prior art, there are deflectors as exhibited by U.S. Pat. Nos. 5,161,263; 4,716,602; and 2,709,816.

There are also structures employing arm rests in U.S. Pat. Nos. 3,905,051; and 3,209,376, but these do not exhibit anterior supporting features.

Various seat mounts are exhibited by U.S. Pat. Nos. 4,964,179; 3,209,376; 4,477,932; and 4,254,514, but these are different structures and do not have the structure's facility for mounting and demounting exhibited by the present invention.

DISCLOSURE OF THE INVENTION

The present invention provides an auxiliary seat having a rear-facing U-shaped base portion with a pair of upstanding arms and an upstanding back portion bridging between the arms. The U-shaped base portion permits entry from the rear and has the leg portions thereof in shaped, spaced apart relation to provide thigh support to a user seated thereon. There is also provided movable anterior trunk support means, to provide support to the upper torso of the user.

In a preferred embodiment, the trunk support means is pivotally secured to the arms of the seat. And the seat further includes movable knee restrain means, which stabilize the posture of and secure the user. The knee restraint means may be individually applicable, such as a pair of strap means. The preferred seat embodiment incorporates hook means for attaching the seat to a support surface. A foot support means which is adjustable in height, provides both a step for the child to transfer onto and off of the seat, and a surface to bear the weight of the child's legs and feet while positioned on the seat. One particular use of the subject seat is upon a toilet, and for that purpose, a latch bar is provided for variable removable attachment to a toilet bowl seat.

The latch bar is preferably provided with a pair of outwardly extending spool members. Upon installation of the seat on a toilet seat equipped with the latch bar, the rearwardly extending hook portions on the seat are passed beneath the bar spools, as the seat is lifted and lowered into position, so that the hook portions embrace the spools, to effectively lock the seat against all but upward pivotal movement relative to the toilet bowl.

BRIEF DESCRIPTION OF THE DRAWINGS

Certain embodiments are described, by way of illustration without limitations thereto other than as set forth in the accompanying claims, reference being made to the accompanying drawings, wherein;

FIG. 2 is a perspective view of a urine deflector used with and forming part of the arrangement;

FIG. 4 is a perspective pictorial view of the installation of an adapter bar on a toilet pedestal;

DETAILED DESCRIPTION OF THE DRAWINGS

Figure 1:
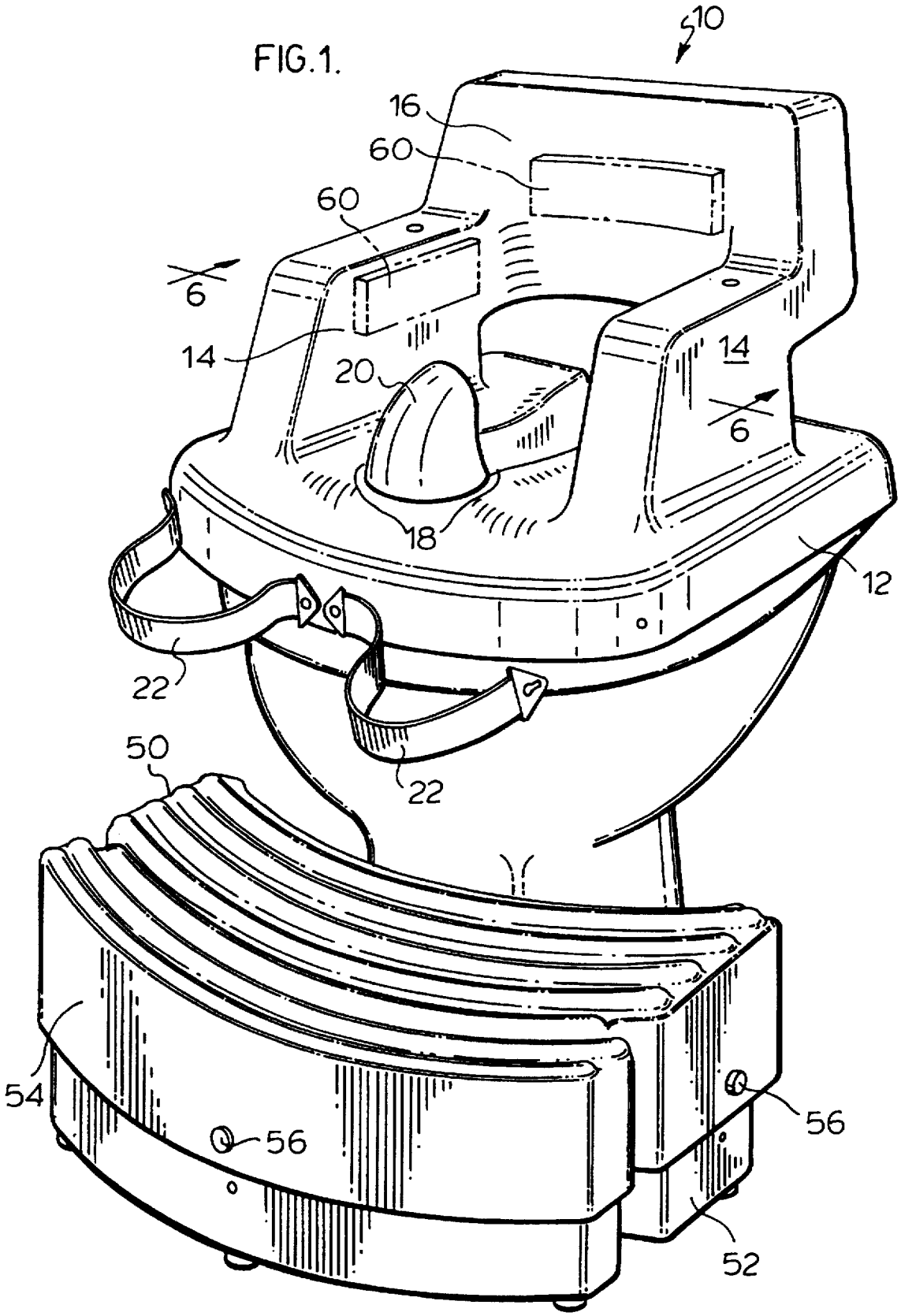
FIG. 1 is a side perspective view of the seat portion of the subject auxiliary seat.

Referring to FIG. 1, an auxiliary seat (10) has a base portion (12), with upstanding arm portions (14), (14) and an interconnecting back portion (16).

Planar portions (18) of the base portion (12) provide thigh-support areas for the user and define a central opening (30).

The back portion (16) comprises a panel which extends vertically between the arms (14). The lower edge (41) of the back (16) defines an upper edge of opening (30) to provide access to the backside of a user on the seat. The front wall of the base (12) is undercut as at (50) to permit flexing of the knees.

A deflector (20) is shown in FIG. 2. This deflector has a first upwardly extending wall (43) which defines a curved channel. An intermediate outwardly extending ridge (44) extends at a distance from the lower end thereby. And the lower end is provided with a further ridge (45). Releasable knee restraint straps 22 stabilize posture and secure the user. The elongate straps include an end piece with a slot to releasably secure the strap 22 to a pin extending from the base 12 as seen in FIG. 1.

Deflector (20) is of flexible material to prevent injury and to permit the two ridges (44) and (45) to engage the adjacent upper and lower surfaces of the front edge of opening (30) with a push fit so that it may be mounted and demounted as required.

The purpose of deflector (20) is to ensure that any urine directed by the child out of the opening (30) is contained and redirected back through the opening (30).

Figure 3:
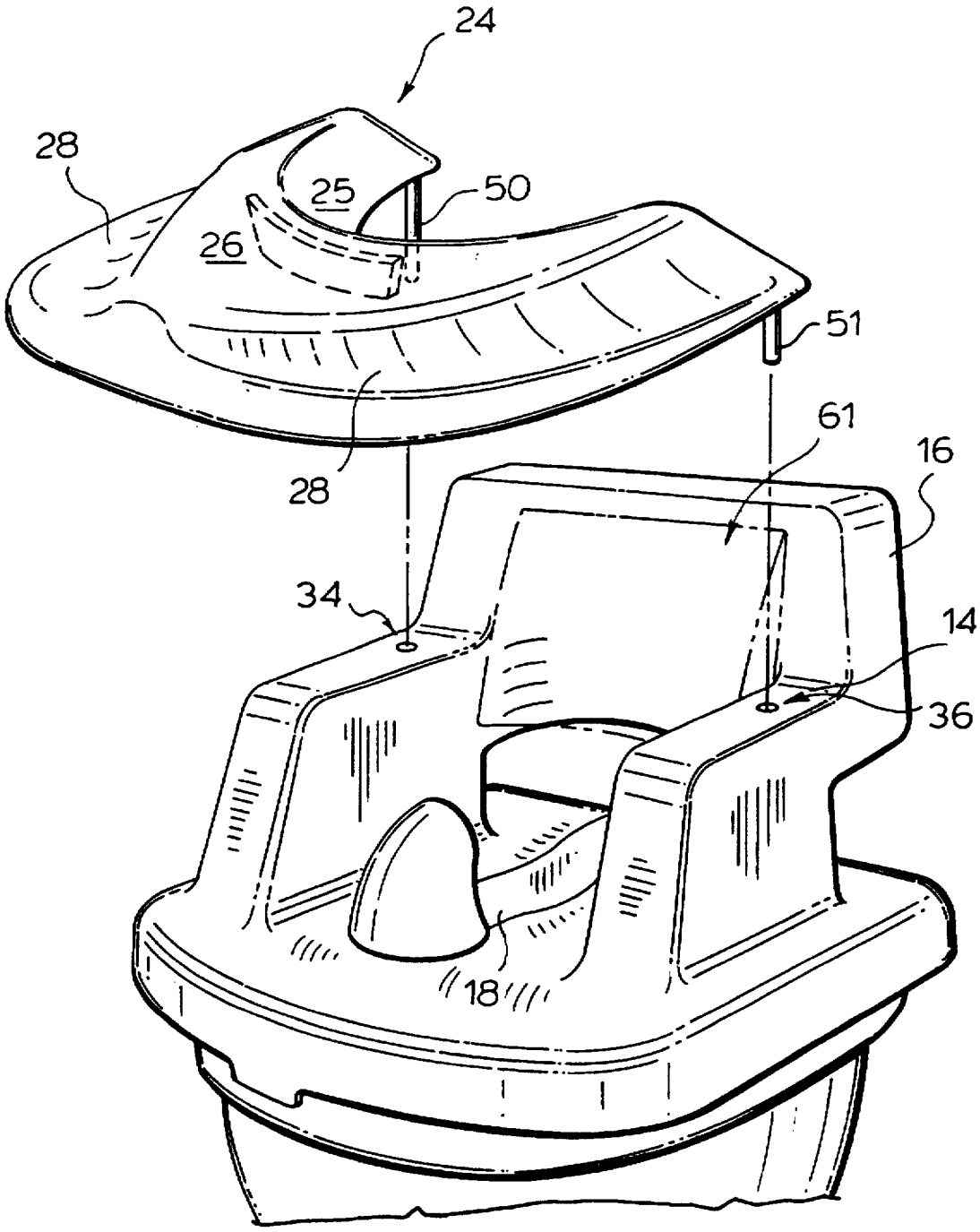
FIG. 3 is an exploded perspective view similar to that of FIG. 1, and having the anterior support in upwardly displaced relation therefrom.

Referring to FIG. 3, the anterior support (24) in the form of a "tray" has a deep, upwardly and forwardly inclined support surface (25) to receive and support the upper trunk portion of the user.

The substantially planar upper surface (26) is bound by surfaces (28) that form arm rests for the user. The edges of the arm rests (28) are of reduced thickness, to provide a ready grip for the user. The "tray" (24) has a first long locating pin (50) and a second shorter locating pin (51). These pins (50), (51) engage and enter into pin holes (34), (36) in the arms (14) to secure the "tray" when the user is seated. The provision of the pins of different length permits the tray to be pulled up and swing away so that the user may move out easily.

Alternatively, it allows the tray to be removed and replaced where this is the preferred approach such as when space does not permit the tray to be pivoted.

The adapter bar (32), shown in FIG. 4, provides the means for securing the auxiliary seat (10) to the toilet pedestal. The preferred embodiment is a flat, rectangular plate bounded by outwardly protruding spools (36). Fastener holes are sized and spaced to permit securement between the toilet lid and pedestal using existing screws and nuts.

Figure 5:
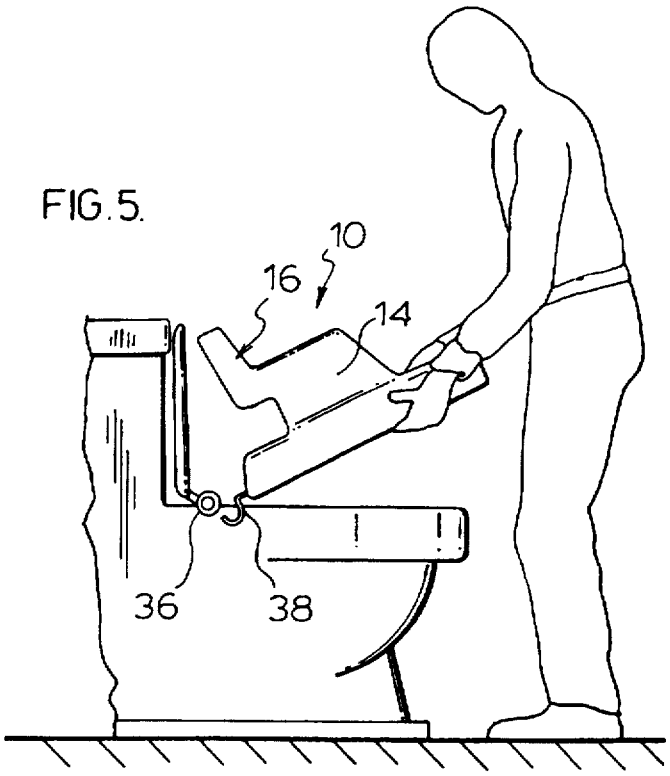
FIG. 5 is a schematic side elevation showing the installation of the auxiliary seat upon a toilet pedestal.
Figure 5A:
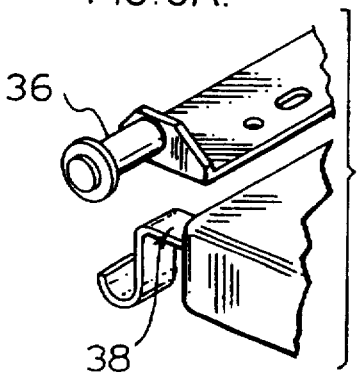
FIG. 5*a* is an enlarged exploded view of the circled area in FIG. 5 showing the detail of the connection between the seat of the present invention and a toilet seat hinge.

Referring to FIG. 5*a*, the spools (36) serve as the latching means for the brackets (38) which project rearwardly in a horizontal manner from the base portion (12). The hook portion of the brackets (38) open upwardly to match the curvature of the spools (36) of the adapter bar (32). When engaged, as shown in FIG. 1, the seat is effectively locked in all but upward pivotal movement relative to the toilet bowl.

Figure 6:
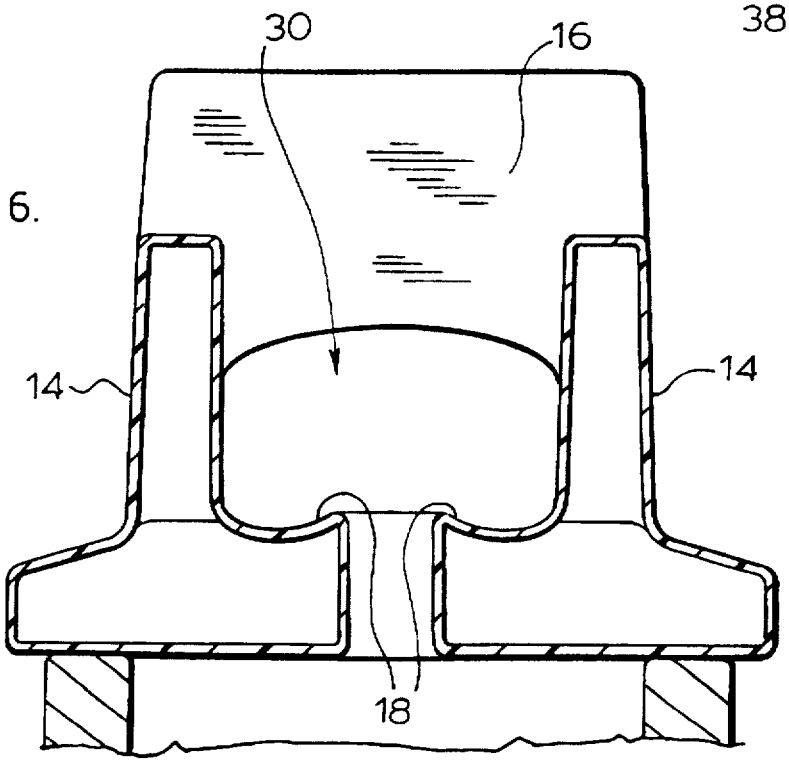
FIG. 6 is a section taken at 6—6 of FIG. 1.

Referring to FIG. 6, it will be seen that the aperture (30) below the back portion (16) gives access to the lower back and bottom of a user, to facilitate cleaning.

A separate foot support (60) of adjustable height may be provided, as shown in FIG. 8. Adjustability of its height may be provided by use of a telescoping portion (52) in laterally pinned relation within an outer casing portion (54). The pins (56), preferably three in number, are inserted through selectively aligned holes, to provide a desired height. The foot support may also be weighted internally by some suitable means to maintain its upright position and avoid movement along the floor when in use.

Detachable pads (61) (shown in phantom) may be secured to the seat (10), on its back (16), and to the anterior surface (25) of the tray (24), in order to achieve a preferred fit of the user in the seat.

In addition to its use with a toilet, the subject auxiliary seat (10) may be used in conjunction with a mobile base such as a stool, for use in a shower. There, the open construction of the seat (10) greatly facilitates access to the user for shower purposes and for drying.

It will of course be understood that the structure contemplated will be preferably of a moldable material which is easily cleaned and manufactured. The mode of manufacture contemplated which appears to lend itself best to the proposed structure is rotational molding. However, it will be appreciated that the most economic approach of those known in the art would be preferred.

From the foregoing, it will be observed that a novel auxiliary seat has been primarily provided for the use of disabled persons. However, it is possible that other children could benefit from the supportive features offered by this seat.

The mounting of the seat on the toilet bowl is easy and permits easy demounting.

The provision of the rear access to the bottom opening of the seat provides a structure which permits for easy cleaning of the exposed parts of the user's body.

It will also be understood that the present seat structure provides means for supporting children in baths or showers and permits their being washed with greater convenience.

What I claim by Letters Patent of the United States is:

1. An auxiliary seat adapted for use with a toilet bowl having a base with a rear-facing elongate slotted opening, a pair of laterally extending upstanding arms; and an upstanding, back portion bridging between the upstanding arms, the back portion having a lower edge spaced apart from said base portion, the seat including a removable anterior trunk support tray mounted on the arms with an upwardly forwardly inclined inner trunk support surface and forward downwardly sloped arm rest surfaces, the trunk support surface and arm rest surfaces defining an upwardly extending central tray portion, a forward edge of the tray having a reduced thickness relative to the central tray portion.

2. An auxiliary seat as claimed in claim 1 wherein said base has portion has inwardly extending flange portions in spaced apart relation, to provide thigh support to a user seated thereon.

3. The auxiliary seat as set forth in claim 2, wherein the trunk support tray is pivotally secured to said seat.

4. The auxiliary seat as set forth in claim 3, including removable, positioning pads to optimize the fit for the user.

5. The auxiliary seat as set forth in claim 2, wherein said base had a forward edge and moveable knee restraint means, secured to said forward edge to stabilize the posture of said user.

6. The auxiliary seat as set forth in claim 5, said knee restrain means comprising a pair of individually adjustable knee restrain means.

7. The auxiliary seat as set forth in claim 5, wherein said knee restraint means comprises a pair of straps.

8. The auxiliary seat as set forth in claim 1, including upwardly and rearwardly extending hook means, secured to said base.

9. The auxiliary seat as set forth in claim 8, in combination with a latch bar, the latch bar being engageable with said hook means, the latch bar adapted to be removably secured to an upper portion of said toilet bowl.

10. The auxiliary seat as set forth in claim 8, including an independent, adjustable foot support.

* * * * *